US005428436A

United States Patent [19]

Sundquist et al.

[11] Patent Number: 5,428,436

[45] Date of Patent: Jun. 27, 1995

[54] SHUTTER ASSEMBLY USING A RESILIENT MATERIAL

[75] Inventors: John D. Sundquist, Clarksville, Va.; Daniel C. Miller, Fairport, N.Y.

[73] Assignee: Xerox Corporation, Stamford, Conn.

[21] Appl. No.: 280,414

[22] Filed: Jul. 26, 1994

[51] Int. Cl.[6] ..... G03G 21/00

[52] U.S. Cl. ..... 355/298; 118/652; 355/260

[58] Field of Search ..... 355/260, 296, 298; 118/652; 222/DIG. 1

[56] References Cited

U.S. PATENT DOCUMENTS

| | | | |
|---|---|---|---|
| 4,478,512 | 10/1984 | Zoltner | 355/260 |
| 4,827,307 | 5/1989 | Zoltner | 355/260 |
| 5,128,724 | 7/1992 | Hayashi et al. | 355/298 |
| 5,235,389 | 8/1993 | Kikuchi et al. | 355/260 |
| 5,381,217 | 1/1995 | Ishida | 355/260 |
| 5,383,578 | 1/1995 | Nishimura | 355/298 X |

FOREIGN PATENT DOCUMENTS

| | | | |
|---|---|---|---|
| 61-6679 | 1/1986 | Japan | 355/298 |
| 2-222984 | 9/1990 | Japan | 355/298 |
| 5-323838 | 12/1993 | Japan | 355/298 |

OTHER PUBLICATIONS

Roberts, C. Thorpe, "Toner Cartridge," *Xerox Disclosure Journal*, vol. 5, No. 2, Mar./Apr. 1980, p. 171.

*Primary Examiner*—William J. Royer
*Attorney, Agent, or Firm*—Zosan S. Soong

[57] ABSTRACT

There is disclosed a shutter assembly including: (a) a surface defining a surface opening; (b) a housing associated with the surface which defines a passageway in communication with the surface opening, wherein the housing surface defining the passageway includes a housing hole; and (c) a resilient material defining an end surface, which is disposed in the passageway and covers the housing hole, wherein the size of the end surface permits the application of an external force against the end surface to compress the resilient material to uncover the housing hole, and whereby the resilient material spontaneously expands to cover the housing hole when the external force ends.

20 Claims, 4 Drawing Sheets

SHUTTER ASSEMBLY USING A RESILIENT MATERIAL

This invention relates generally to a shutter assembly which may be used in for example an electrostatographic printing apparatus and in particular in a storage sump for the storage of developer particles cleaned from a charge-retentive surface.

In the process of electrostatographic printing, a charge-retentive surface, such as a photoreceptor, is charged to a substantially uniform potential so as to sensitize the surface thereof. The charged portion of the photoconductive surface is exposed to a light image of an original document being reproduced, or else a scanned laser image created by the action of digital image data acting on a laser source. The scanning or exposing step records an electrostatic latent image on the photoreceptor corresponding to the informational areas in the document to be printed or copied. After the latent image is recorded on the photoreceptor, the latent image is developed by causing toner particles to adhere electrostatically to the charged areas forming the image. This developed image on the photoreceptor is subsequently transferred to a sheet on which the desired image is to be printed. Finally, the toner on the sheet is heated to permanently fuse it to the sheet in image configuration.

One familiar type of development of an electrostatic image is called "two-component development." Two-component developer largely comprises toner particles interspersed with carrier particles. The carrier particles are magnetically attractable, and the toner particles are, caused to adhere triboelectrically to the carrier particles. This two-component developer can be conveyed, by means such as a "magnetic roll," to the electrostatic latent image, where toner particles become detached from the carrier particles and adhere as desired to the electrostatic latent image.

Development of the electrostatic image with developer particles results in the generation of waste developer particles which are removed and stored in a waste sump disposed within the electrostatographic printing apparatus. A waste sump is designed with one or more openings which allow an auger to deposit waste developer particles inside the sump. When full, the sump is removed from the electrostatographic printing apparatus. Prior to removal of the waste sump, the openings of the waste sump are sealed with for example a plug to minimize spillage of the waste developer particles. However, the motions needed to attach a plug to the waste sump openings typically cause spillage of the waste developer particles. There is a need for a waste sump shutter which automatically seals or closes a waste sump opening immediately upon withdrawal of the waste auger so that the sump can be moved within and removed from the electrostatographic apparatus without spilling the waste developer particles.

Roberts, Xerox Disclosure Journal, Vol. 5, No. 2, p. 171 (March/April 1980), discloses a toner cartridge using a foam seal 16.

Marotta et al., U.S. Appln. Ser. No. 08/157,514 filed Nov. 26, 1993, discloses a shutter seal assembly comprising a number of mechanical components including integral shutter spring seal members.

Other toner cartridges and electrostatographic printing apparatus are illustrated for example in Kikuchi et al., U.S. Pat. No. 5,235,389; Zoltner, U.S. Pat. No. 4,827,307; and Zoltner, U.S. Pat. No. 4,478,512, the disclosures of which are totally incorporated by reference.

Attention is directed to the following phrases. As used herein, the phrase "electrostatographic printing apparatus" includes copying devices and/or printing devices. Also, unless otherwise indicated herein, the phrases "toner cartridge" and "developer cartridge" have the same meaning. As used herein, the phrase "resilient material" refers to a substance, for example open cell foam, which can be compressed when subjected to a compression force and which can spontaneously expand when the compression force decreases or terminates.

SUMMARY OF THE INVENTION

It is an object of the invention to provide a waste sump shutter which uses a minimum of parts, thereby reducing the costs of the shutter.

It is a further object of the invention to provide a waste sump shutter which prevents or minimizes waste developer particle spillage during movement of the waste sump.

It is an additional object of the invention to provide a waste sump shutter which automatically seals or closes a waste sump opening immediately upon withdrawal of the waste auger so that the sump can be moved within and removed from the electrostatographic apparatus without spilling the waste developer particles.

These objects and others are accomplished by providing a shutter assembly comprising:

(a) a surface defining a surface opening;

(b) a housing associated with the surface which defines a passageway in communication with the surface opening, wherein the housing surface defining the passageway includes a housing hole; and (c) a resilient material defining an end surface, which is disposed in the passageway and covers the housing hole, wherein the size of the end surface permits the application of an external force against the end surface to compress the resilient material to uncover the housing hole, and whereby the resilient material spontaneously expands to cover the housing hole when the external force ends.

In embodiments of the instant invention, there is provided an electrostatographic printing apparatus comprising:

(a) a charge retentive surface;

(b) a developer container including a supply of developer particles; and (c) a waste developer container defining a chamber and a container opening;

(d) a housing associated with the waste developer container, which defines a passageway in communication with the container opening, wherein the housing surface defining the passageway includes a housing hole, and wherein the housing hole is in communication with the chamber; and (e) a resilient material defining an end surface, which is disposed in the passageway and covers the housing hole, wherein the size of the end surface permits the application of an external force against the end surface to compress the resilient material to uncover the housing hole, and whereby the resilient material spontaneously expands to cover the housing hole when the external force ends.

In additional embodiments of the present invention, there is provided a shutter assembly comprising:

(a) a housing having a first end and a second end, wherein the first end defines an aperture, and the housing further defines a passageway in communication with the first end, wherein the housing surface defining the passageway includes a housing hole; and (b) a resilient material defining an end surface, which is disposed in the passageway and covers the housing hole, wherein the size of the end surface permits the application of an external force against the end surface to compress the resilient material to uncover the housing hole, and whereby the resilient material spontaneously expands to cover the housing hole when the external force ends.

BRIEF DESCRIPTION OF THE DRAWINGS

Other aspects of the present invention will become apparent as the following description proceeds and upon reference to the Figures which represent preferred embodiments and are substantially to scale.

Unless otherwise noted, the same reference numeral in the Figures refers to the same or similar feature.

DETAILED DESCRIPTION

Figure 1:
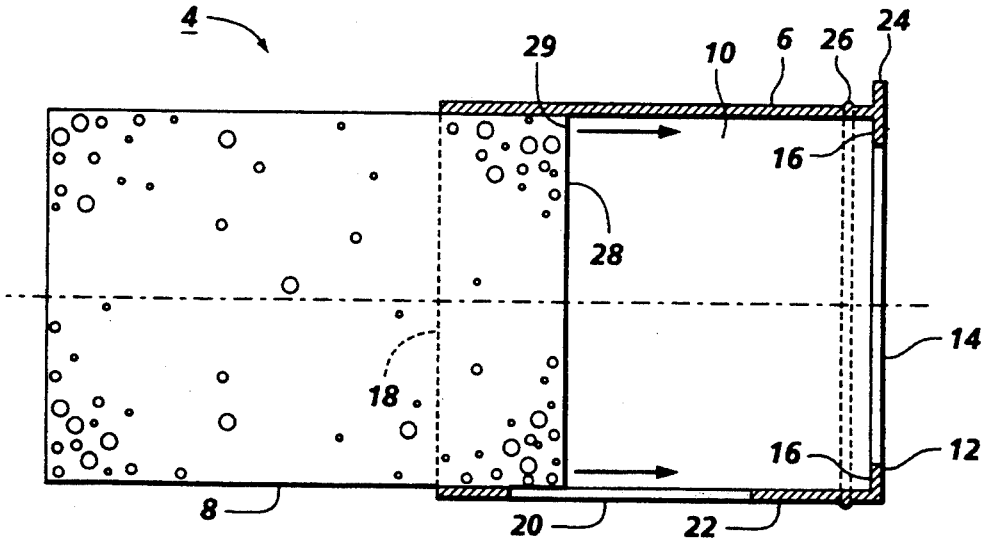
FIG. 1 is a side, schematic view of the shutter assembly comprised of the shutter housing, the resilient material, and the substantially rigid sheet coupled to the resilient material.

In FIG. 1, shutter assembly 4 is comprised of shutter housing 6 and resilient material 8. Housing 6 defines a passageway 10 which may be cylindrically shaped. Housing 6 has a first end 12 which defines an aperture 14, preferably circularly shaped, to admit for example the waste auger (not shown in this Figure). The first end 12 may be partially open and defines a first end surface 16 to provide a stop for the resilient material 8. The housing 6 has a second end 18 which may be entirely open to admit the resilient material. Housing 6 further defines a hole 20, preferably disposed at the base 22 of the housing 6, which is in communication with the passageway 10. In the embodiments, the outer surface of the housing 6 may be cylindrical with the base 22 being planar. Housing 6 may further comprise an integral flange 24 and an integral rib 26, spaced from one another, to couple the housing to a surface in the form of for example a container (not shown in this Figure). Rib 26 may extend around the entire outer circumference of the housing. Flange 24 may extend around the first end 12 except the base 22 of the housing. Housing 6 may be fabricated from any suitable material including a plastic.

The resilient material 8 may be for example cylindrically shaped and is sized to fit into the passageway 10. The resilient material may comprise a foam material, especially open cell foam, fabricated from for example polyurethane. In a preferred embodiment, a substantially rigid sheet 28, which may be circular in shape, is coupled by for example an adhesive to an end surface 29 of the resilient material. The substantially rigid sheet 28 may have a thickness ranging for example from about 0.1 mm to about 2 mm, and preferably about 0.5 mm, and may have the same, similar, or different cross-sectional dimension and cross-sectional shape as the resilient material. The substantially rigid sheet may be a plastic sheet including a polyester such as polyethylene terephthalate. The resilient material 8 and the coupled substantially rigid sheet 28 enter the housing 6 through the preferably open second end 18 and the substantially rigid sheet is positioned adjacent the first end surface 16, whereby the first end surface may prevent or minimize movement of the resilient material and the substantially rigid sheet through the first end 12. Preferably, the resilient material 8 extends beyond the second end 18 of the housing by a length ranging for example from about 5 mm to about 20 mm. In the embodiments, the cross-sectional dimension of the resilient material is approximately the same as the cross-sectional dimension of the passageway 10. The end surface 29 of the resilient material may have any suitable dimension to provide a surface for an engaging device such as a waste developer auger to press against. In the embodiments, the end surface 29 of the resilient material is parallel with the plane of the aperture 14 defined by the first end 12.

Figure 2:
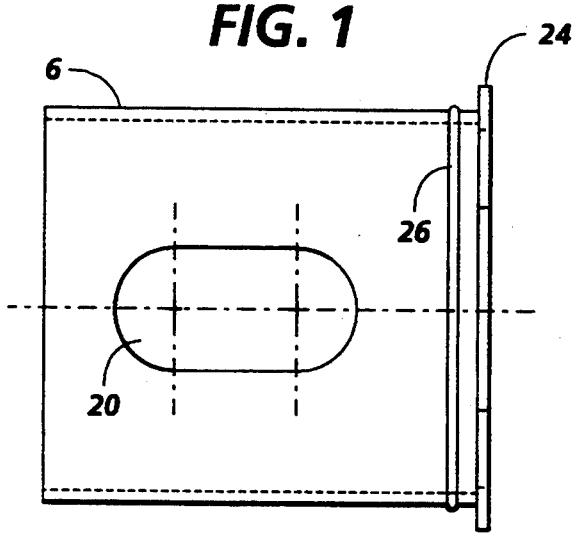
FIG. 2 is a bottom, schematic view of the shutter housing.

In FIG. 2, housing 6 is comprised of a hole 20, a rib 26, and a flange 24. The distance between the rib and the flange may be the wall thickness of the surface defining an opening (not shown in this Figure). The surface may be in the form of a container. Preferably, the hole 20 is positioned at the base 22 of the housing, but the hole 20 may be disposed in embodiments of the instant invention at any other suitable place including the side of the housing. In the embodiments, there may be a plurality of housing holes 20 such as two, three, or more.

Figure 3:
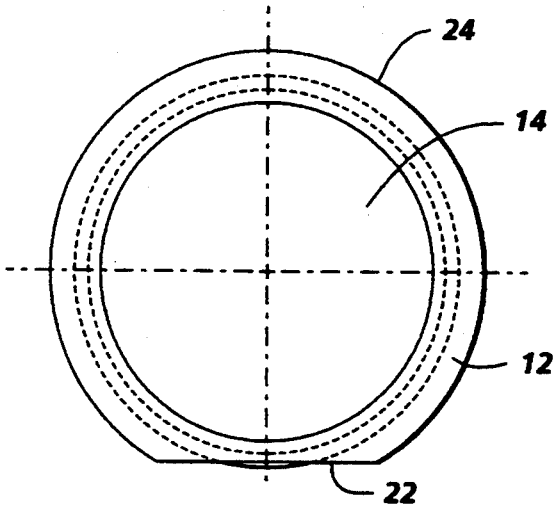
FIG. 3 is a front, schematic view of the shutter housing.

FIG. 3 illustrates a front view of the housing 6 which includes flange 24, first end aperture 14, and planar base 22, as seen through the first end 12.

Figure 4:
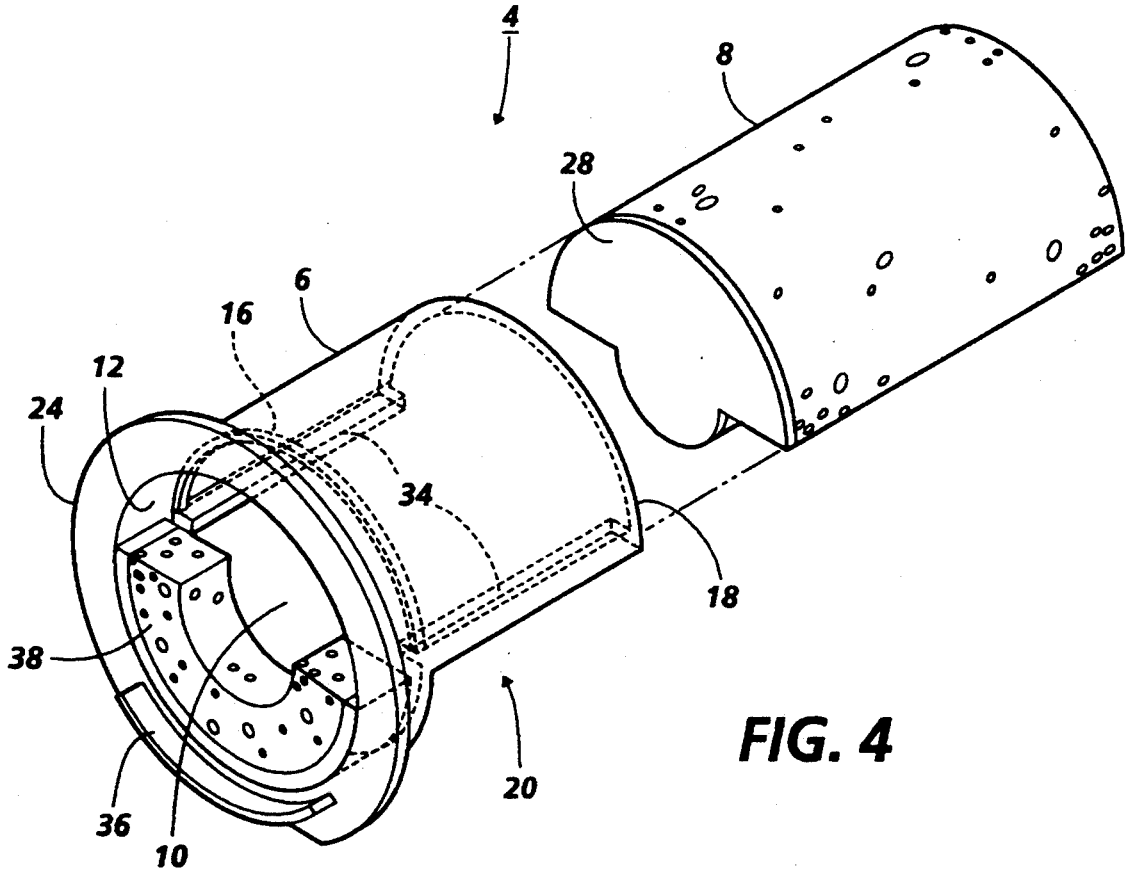
FIG. 4 is a schematic, perspective view of an alternative configuration of the shutter assembly.

FIG. 4 represents an alternative embodiment of the shutter assembly 4. Approximately the bottom half of the surface of the shutter housing 6 defining passageway 10 is removed to expand the size of housing hole 20 to about the length and width of the passageway 10. Integral rails 34 are defined by the shutter housing 6 to slidably engage the resilient material 8 and the coupled sheet 28. The first end surface 16 may be in the form of a rib to provide a stop surface for the sheet 28 and the material 8. A foam strip 38 may be attached by an adhesive to the front of the shutter housing 6 to provide a wipe surface for the auger (not shown). An integral apron member 36 is disposed at the front of the shutter housing 6. The sheet 28 and the resilient material 8 both have configurations which resemble integral half moon shapes. A portion of the flat surface of the sheet 28 and the material 8 slidably engages the top of rails 34.

Figure 5:
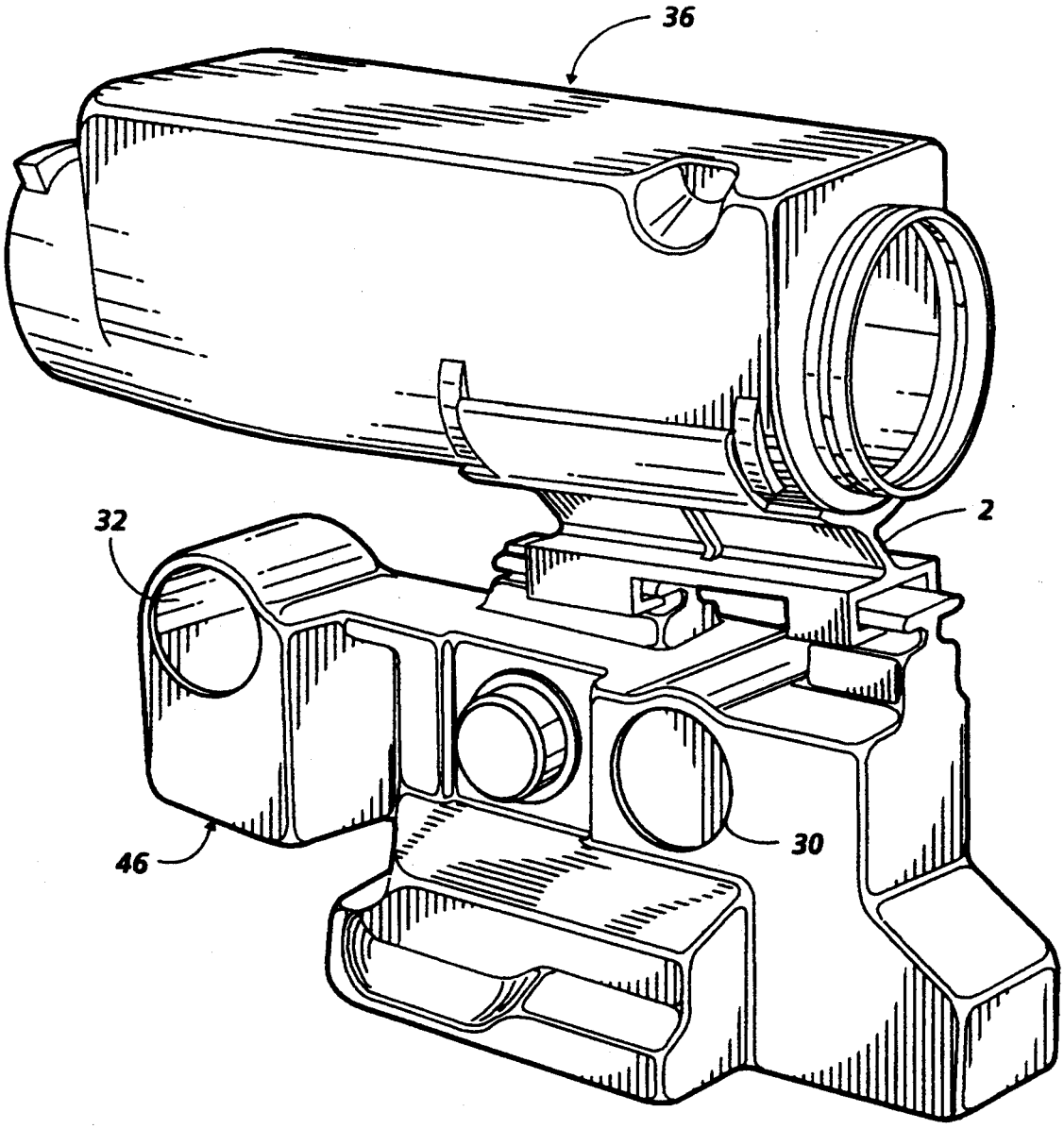
FIG. 5 is a perspective, schematic view of an assembly comprised of a developer container, a waste developer container, and a coupling member.

In FIG. 5, an assembly is illustrated comprised of a developer container 36, a waste developer container 46, and coupling member 2, which may be detachably coupled to the developer container 36 and the waste developer container 46. Further details of this assembly are disclosed in Sundquist, U.S. Appln Ser. No. 08/254,204 filed Jun. 6, 1994, the disclosure of which is totally incorporated by reference. Developer container 36 may be the housing of a developer cartridge to accommodate developer particles. Unless otherwise indicated herein, the term developer refers to a mixture of toner and carrier particles, or to toner particles without carrier particles. Developer container 36 may further comprise additional components (not shown in this Figure) typically employed for developer cartridges including for example a mixing auger disposed within the chamber of the developer container 36. Waste developer container 46 may be the housing of a waste sump for waste developer for electrostatographic printing apparatus. Waste developer container 46 may define a first opening in communication with a chamber for waste toner particles and a second opening in communication with a chamber for waste carrier particles.

The shutter assembly 4 (refer to FIGS. 1–4) comprised of the shutter housing 6, the resilient material 8, and the substantially rigid sheet 28 coupled to the end surface 29 of the resilient material, may be assembled together and then disposed in the first opening 30 of the waste developer container 46. The shutter housing 6 may be sized to slide through the first opening 30 (second end 18 of the housing first through the first opening 30) into a chamber wherein the outer cross-sectional dimension of the housing may be the same or slightly smaller than the cross-sectional dimension of the first opening 30. The housing 6 is at least partially disposed in the chamber, and is preferably substantially disposed in the chamber. The housing 6 is inserted into the first opening 30 until the wall defining the first opening 30 is positioned between the rib 26 and the flange 24, thereby coupling or securing the housing to the waste developer container 46. Preferably, the hole 20 in the housing is oriented below the horizontal midplane of the first opening 30, and especially at around the 6 o'clock position of the first opening 30. The hole 20 is in communication with the chamber for the waste toner particles. Preferably, the length of the resilient material is selected to be longer than that of the shutter housing so that the resilient material may extend from the open second end of the housing to contact the inside surface of the waste developer container 46. Preferably, the length of the resilient material is selected such that the resilient material is slightly compressed when one end surface of the resilient material contacts the inside surface of the waste developer container; this may ensure an extra springiness to the resilient material which may urge the coupled sheet 28 against the first end surface 16 of the housing 6. The dimensions of the resilient material are selected to prevent or minimize movement of particles into or out of the waste toner chamber either through the housing hole 20 or through the second end 18 of the housing when the resilient material is in the normal expanded state, i.e, prior to the compression force created by the auger in a preferred embodiment, the resilient material occupies the entire volume of the passageway 10. In an embodiment of the instant invention, the shutter housing 6 is integral with the waste developer container 46 including the embodiments where the shutter housing and the waste developer container are formed of a single-piece or where the shutter housing and the waste developer container are fixedly joined by for example welding or by an adhesive.

Operation of the shutter assembly 4 in the first opening 30 of the waste developer container 46 proceeds as follows. The tip of an auger (not shown in this Figure) carrying waste toner contacts the substantially rigid sheet 28 and pushes against the sheet which creates a compression force that compresses the resilient material 8 against the inner surface of the waste developer container 46. The auger advances into the passageway 10 of the shutter housing and pushes against the sheet 28 to further compress the resilient material, thereby uncovering the hole 20 in the housing. An aperture in the auger matches up with the hole 20 in the housing when for example the auger is fully inserted into the shutter housing. Waste toner falls from the auger aperture and drops through the hole 20 into the chamber for waste toner particles under the influence of gravity. When the auger is withdrawn from the shutter housing and the compression force directed against the sheet 28 decreases or terminates, the resilient material spontaneously and immediately expands to cover the hole 20 in the housing and the sheet may advance to lie adjacent to the first end surface 16. In the embodiments of the instant invention, the resilient material in the fully expanded state blocks the aperture 14 of the first end 12, the second end 18, and the housing hole 20; the resilient material in the compressed state allows access to the aperture 14 and the housing hole 20, but blocks the second end 18.

In an alternate embodiment, the shutter housing 6 may have a partially closed or entirely closed second end 18. The housing may be fabricated with such a partially or entirely closed second end or a plug may be coupled to the second end 18. The resilient material 8 and the coupled sheet 28 may be inserted into the shutter housing through the aperture 14 of the first end 12. In this alternate embodiment, the resilient material is compressed against the second end 18, rather than against the inner surface of the waste developer container 46.

A second shutter assembly (not shown in this Figure) may be similarly disposed in a second opening 32 of the waste developer container 46 and may operate in a similar fashion as discussed above.

Figure 6:
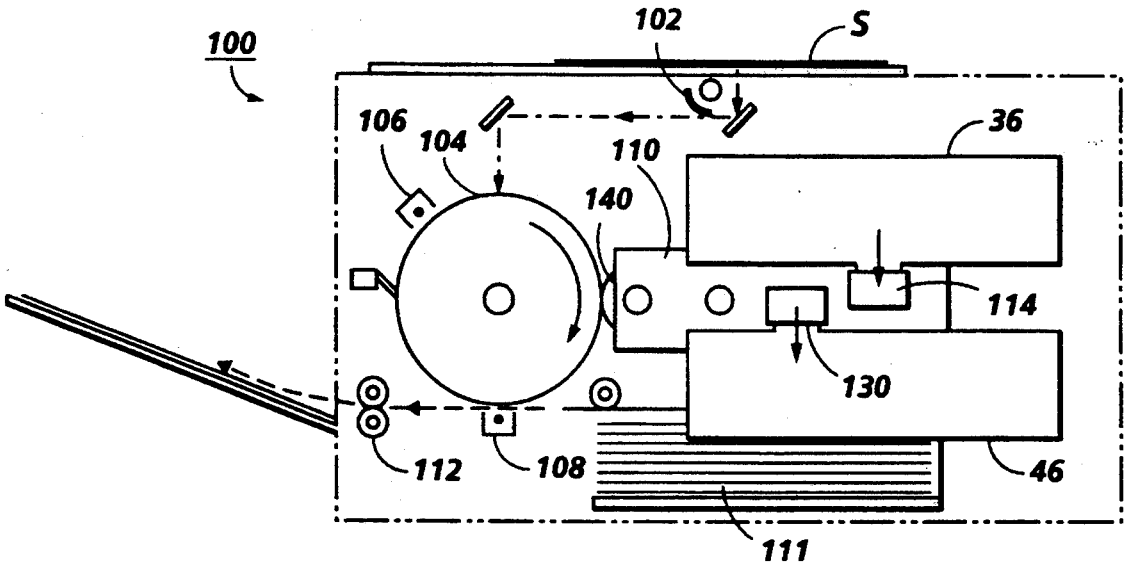
FIG. 6 is a schematic, side view showing the elements of an electrostatographic printer, in this case a copier, which may employ the shutter assembly of the instant invention.

FIG. 6 shows the basic elements of an electrostatographic printer, in this case a copier. The copier, generally indicated as 100, includes an exposure means 102, which may include a lamp, mirror, and self-focusing lens arrangement for obtaining an exposure of an original on sheet S to be copied. The image on sheet S is then exposed onto the surface of a photoreceptor 104 which has been previously charged by means of a corotron 106. When the charged surface of photoreceptor 104 is exposed to the image on sheet S, various portions of the surface will be discharged in imagewise fashion as they are exposed to light from the image. Those areas of the photoreceptor 104 which were not discharged in the exposure step are then developed by development unit 110, and in particular by the magnetic roll 140, so that toner is caused to adhere to the charged areas of photoreceptor 104, creating a "developed" image of the original. This developed image is then moved, by the rotation of photoreceptor 104, to a transfer station 108, where the toner on the photoreceptor is electrostatically transferred to a sheet of plain paper from stack 111. The sheet from stack 111 which receives the toner particles in imagewise fashion, is then sent through a fuser 112, which causes the toner particles to be melted onto the sheet to form a permanent image.

The present invention is useful for electrostatographic printing apparatus which utilize for example "trickle" development. Trickle development is further discussed in Folkins et al., U.S. Pat. No. 4,614,165, the disclosure of which is totally incorporated by reference. In trickle development, there is provided a main supply of developer, which is drawn upon for application to an electrostatic latent image on photoreceptor 104, and a second supply of developer, which gradually discharges, or trickles, into the main developer supply. In most embodiments of trickle development, the main and secondary supplies of developer have substantially different percentages of toner to carrier particles (also referred to herein as "T/C"). The main developer supply is retained in the development unit 110, while the secondary developer supply is discharged into the development unit 110 through input port 114. Simultaneously, in order to maintain both a relatively stable amount of developer in development unit 110, and also to maintain the T/C of the developer in development unit 110 within an optimal range, a certain quantity of developer is discharged through output port 130.

In FIG. 6, there can be seen, interacting with development unit 110, a developer container 36 (which is the housing of a developer cartridge), and a waste developer container 46 (which is the housing of a waste sump). A coupling member (not shown) couples the container 36 to the container 46. Developer container 36 can supply either toner alone or toner and carrier particles to input port 114 of development unit 110, while the waste developer container 46 receives used developer from output port 130. The shutter assembly of the instant invention (not shown in this Figure) may be coupled to the waste developer container 46 as discussed herein. In a typical trickle development arrangement, the developer in the developer container 36 will have a T/C of 25% carrier by weight and 75% toner by weight, while the developer in the development unit 110 will be maintained at a T/C of about 96% carrier by weight and 4% toner by weight. The assembly comprised of the developer container, the waste developer container, and the coupling member are removable from the printer apparatus, with a new assembly being installable by an end user.

Although, in the above-described embodiment of a trickle development system, it is intended that a secondary developer supply have a different T/C than the main developer supply within development unit 110, it is conceivable to provide a development unit wherein the developer being input into the development unit is of the same T/C as the developer already in the development unit, possibly with equal-rate displacement of input and output developer through the development unit 110. It is also conceivable that, instead of a developer comprised of both toner and carrier particles being provided into input port 114, pure toner, with no carrier therein, be supplied into development unit 110.

Other modifications of the present invention may occur to those skilled in the art based upon a reading of the present disclosure and these modifications are intended to be included within the scope of the present invention.

What is claimed is:

1. A shutter assembly comprising:

(a) a surface defining a surface opening;

(b) a housing associated with the surface which defines a passageway in communication with the surface opening, wherein the housing surface defining the passageway includes a housing hole; and (c) a resilient material defining an end surface, which is disposed in the passageway and covers the housing hole, wherein the size of the end surface permits the application of an external force against the end surface to compress the resilient material to uncover the housing hole, and whereby the resilient material spontaneously expands to cover the housing hole when the external force ends.

2. The assembly of claim 1, wherein the housing includes a flanged end portion.

3. The assembly of claim 1, wherein the cross..sectional dimension of the material is approximately the same as the cross-sectional dimension of the passageway.

4. The assembly of claim 1, wherein the surface is a container.

5. The assembly of claim 1, wherein the surface further defines a chamber in communication with the housing hole.

6. The assembly of claim 1, wherein the housing is integral with the surface.

7. The assembly of claim 1, wherein the housing is hollow and comprises a partially open first end and an entirely open second end.

8. The assembly of claim 1, wherein the material is open cell foam.

9. The assembly of claim 1, further comprising a plastic sheet coupled to the end surface of the material.

10. The assembly of claim 1, wherein the material is cylindrically shaped.

11. The assembly of claim 1, further comprising a substantially rigid sheet coupled to the end surface of the material.

12. An electrostatographic printing apparatus comprising:

(a) a charge retentive surface;

(b) a developer container including a supply of developer particles; and (c) a waste developer container defining a chamber and a container opening;

(d) a housing associated with the waste developer container, which defines a passageway in communication with the container opening, wherein the housing surface defining the passageway includes a housing hole, and wherein the housing hole is in communication with the chamber; and (e) a resilient material defining an end surface, which is disposed in the passageway and covers the housing hole, wherein the size of the end surface permits the application of an external force against the end surface to compress the resilient material to uncover the housing mole, and whereby the resilient material spontaneously expands to cover the housing hole when the external force ends.

13. The apparatus of claim 12, wherein the cross-sectional dimension of the material is approximately the same as the cross-sectional dimension of the passageway.

14. The apparatus of claim 12, wherein the housing is integral with the waste developer container.

15. The apparatus of claim 12, wherein the housing is hollow and comprises a partially open first end and an entirely open second end.

16. The apparatus of claim 12, wherein the material is open cell foam.

17. The apparatus of claim 12, further comprising a plastic sheet coupled to the end surface of the material.

18. The apparatus of claim 12, wherein the material is cylindrically shaped.

19. The apparatus of claim 12, further comprising a substantially rigid sheet coupled to the end surface of the material.

20. A shutter assembly comprising:

(a) a housing having a first end and a second end, wherein the first end defines an aperture, and the housing further defines a passageway in communication with the first end, wherein the housing surface defining the passageway includes a housing hole; and (b) a resilient material defining an end surface, which is disposed in the passageway and covers the housing hole, wherein the size of the end surface permits the application of an external force against the end surface to compress the resilient material to uncover the housing hole, and whereby the resilient material spontaneously expands to cover the housing hole when the external force ends.

* * * * *